United States Patent [19]

Mayer, Jr.

[11] Patent Number: 4,518,083

[45] Date of Patent: May 21, 1985

[54] POULTRY TRUSSING DEVICE CARTRIDGE

[75] Inventor: Oscar C. Mayer, Jr., Lititz, Pa.

[73] Assignee: Woodstream Corporation, Lititz, Pa.

[21] Appl. No.: 553,628

[22] Filed: Nov. 21, 1983

[51] Int. Cl.[3] ..... B65D 83/00

[52] U.S. Cl. ..... 206/340; 17/1 S

[58] Field of Search ..... 17/1 R, 1 S, 44.4; 53/581; 206/338, 340, 341, 493

[56] References Cited

U.S. PATENT DOCUMENTS

| | | | |
|---|---|---|---|
| 354,235 | 12/1886 | Richards | 206/338 |
| 514,699 | 2/1894 | Brown | 206/340 |
| 4,050,578 | 9/1977 | Eckert | 206/340 |

*Primary Examiner*—Willie G. Abercrombie

*Attorney, Agent, or Firm*—Holman & Stern

[57] ABSTRACT

A rack or cartridge for storing multiple poultry trussing wires in nested relationship includes an elongated sheet with at least three longitudinally folds or bends to define four sheet sections. Two of the bends are disposed transversely equidistant from the central bend to define a recess adapted to receive the central portion of the trussing wire. In one embodiment the outer sections bend back generally toward one another to terminate in an elongated space adapted to receive central sections of the trussing wires. In another embodiment the outer sections are bent away from one another to define an M-contoured rack cross-section, there being plural such racks spaced transversely from one another on an integral member. The wires may be automatically fed into the cartridge and individually removed therefrom. The outer bends in both embodiments support the trussing wire segments which extend above the recess.

24 Claims, 9 Drawing Figures

FIG. 1
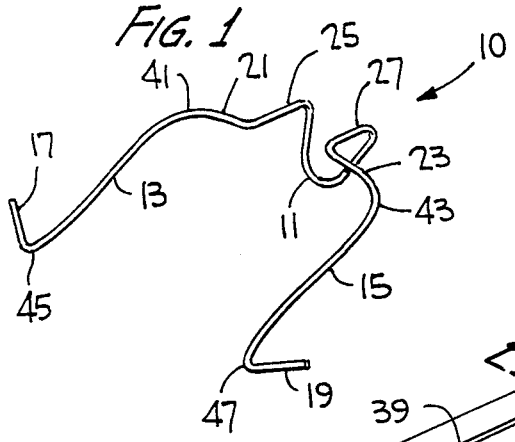
FIG. 2
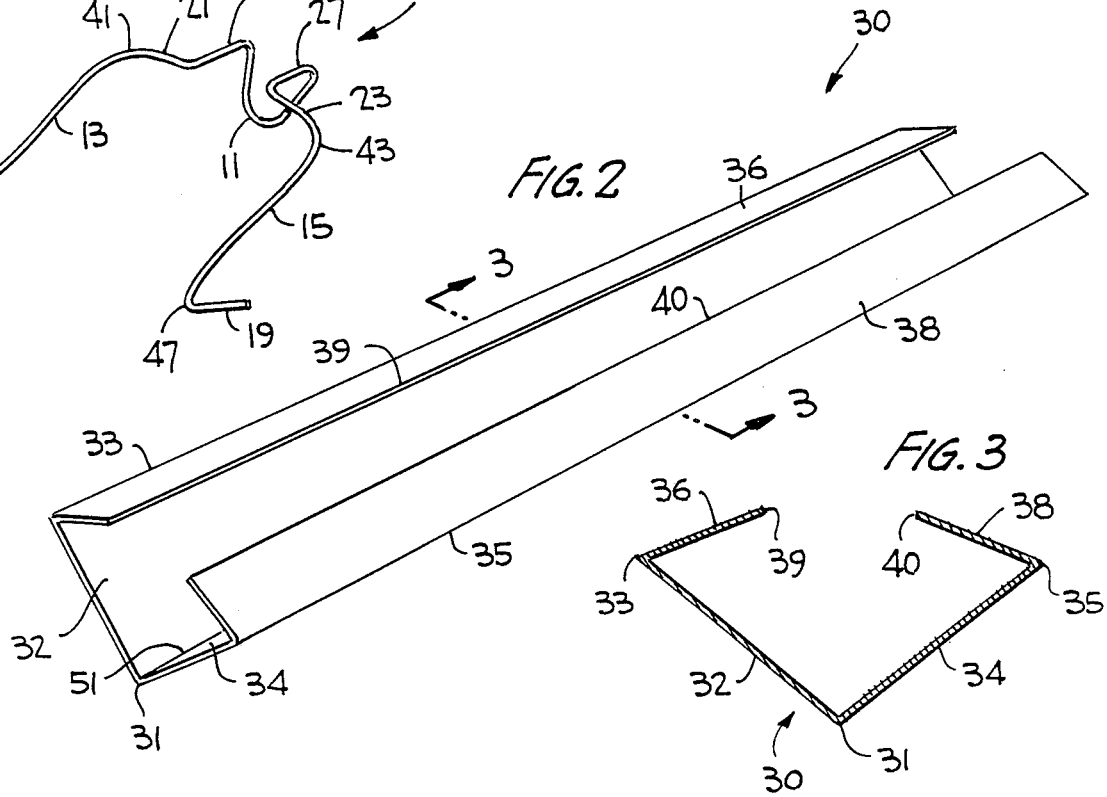
FIG. 3
FIG. 4
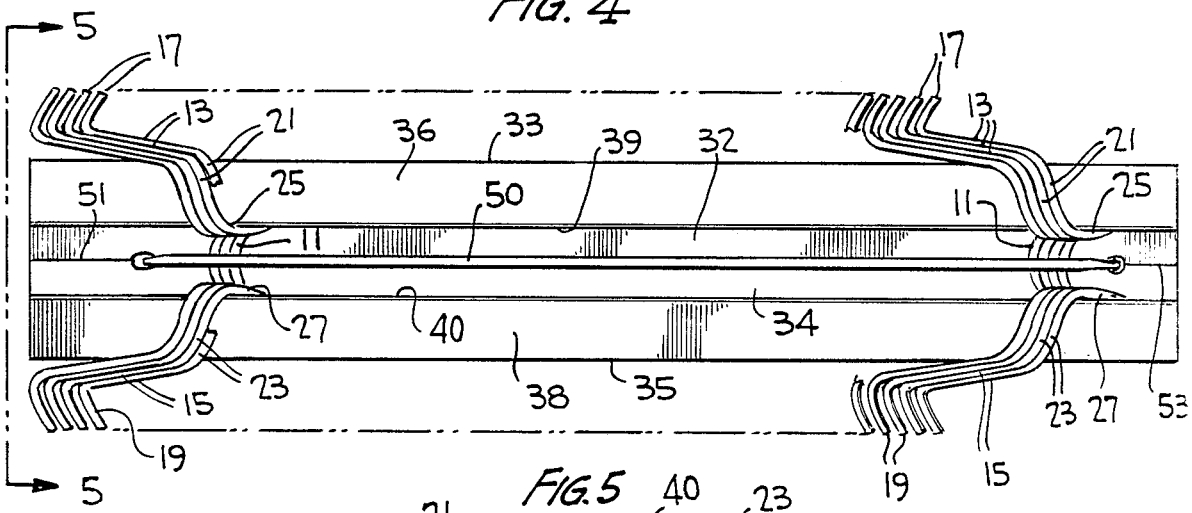
FIG. 5
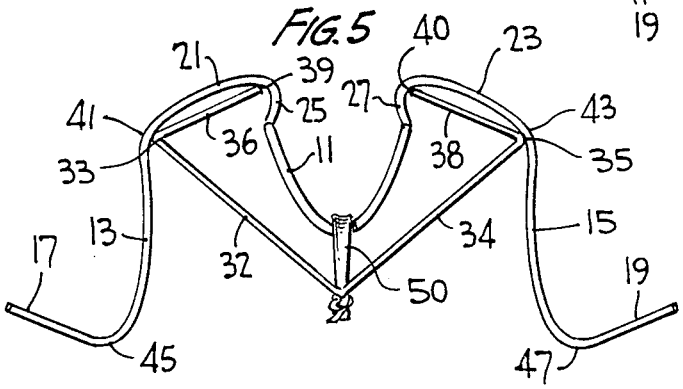

POULTRY TRUSSING DEVICE CARTRIDGE

BACKGROUND OF THE INVENTION

1. Technical Field

The present invention relates to racks or cartridges for shipping, storing and dispensing poultry trussing devices and, more particularly, to such racks or cartridges which hold multiple poultry trussing wires in nested relation.

2. Discussion of the Prior Art

In the commercial processing of dressed poultry, it is common to "truss" each eviscerated fowl using a single length of stiff but resilient wire. The term "truss", as used in the trade, denotes the retention of the legs of the fowl in a position closely folded toward one another and against the body of the bird. An example of a trussing device of this type is found in U.S. Pat. No. 3,112,515 (Volk), the disclosure of which is expressely incorporated herein by reference in its entirety.

Although trussing wires of the type disclosed by Volk are quite effective to achieve the trussing function, the multiple bends in the preformed wire, which place various sections of the wire in different planes, present problems in shipping, storing and dispensing the wires. If the wires are left loose in a container, they tend to tangle and result in considerable waste of valuable time when one attempts to separate wires during a commercial trussing process. There is a need, therefore, for apparatus which can receive the trussing wires at the end of a wire bending fabrication procedure, and which can store the formed wires for shipping and facilitated dispensing.

OBJECTS AND SUMMARY OF THE INVENTION

It is therefore an object of the present invention to provide a method and apparatus for storing, shipping and dispensing poultry trussing wires.

It is a further object of the present invention to provide a method and apparatus for permitting multiple poultry trussing wires to be conveniently stored in nested relation so that they may be shipped and easily dispensed when needed for use in common trussing procedures.

Trussing wires to be stored in accordance with the present invention take the form of a length stiff but resilient wire with plural bends. A generally V-shaped segment is connected to leg segments via respective transition segments. The leg segments, which include co-planer hooked portions at their ends, extend forwardly from the hooked portions and define a first plane which forms an obtuse angle with a second plane in which the transition segments reside. A third plane contains the V-shaped wire center segment which is bent at an obtuse angle relative to the second plane so that the point of the V is directed obliquely to the first plane and generally rearwardly.

In accordance with one embodiment of the present invention, a storage cartridge or rack is provided in the form of an elongated member with three longitudinally-extending bends or folds. The first or central bends are disposed at equal transverse distances from the first bend and are nominally 45° and directed such that the longitudinally-extending edges of the elongated member face one another at an angle and in generally spaced relation. The space between these longitudinally-extending edges is such that the central V-shaped segment and transition segment of the trussing wires fit therein with the point of the V-shaped segment disposed in a recess formed by the first bend in the elongated member and directed generally toward that first bend. In this position, proximal portions of the leg segments rest on respective edges and on the second and third bends, respectively, of the elongated member. The leg segments are each bent to extend along the outside of the rack to provide support points, along with the outer edge of the first bend in the elongated member, for rack and trussing wires. The assembly, as thusly deployed, permits multiple trussing wires to be nested on the rack and removed one at a time therefrom without mutual entanglement. A strip of tape, a rubber band or a strap can be disposed longitudinally in the interior cartridge recess and along the V-shaped center segments of the nested trussing wires to prevent inadvertant removal of the wires from the rack during shipping and storage. For this purpose, the ends of the rack may be provided with short slits extending along the central or first bend to receive the rubber band or ends of the tape or strip. The rack member itself may be made of cardboard, metal or plastic.

In accordance with a second embodiment of the invention, an elongated rack member is adapted to support plural rows of nested trussing wires. A support section for each row includes five transverely-spaced longitudinally-extending bends which, in transverse cross-section, provide a generally M-shaped contour. The plural M-shaped sections are transversely spaced from one another. The trussing wires are supported with their central V-shaped disposed in the recess formed between the two inner legs of the M-shaped sections. The bends which define the intersections of the outer and inner M-section legs serve to support the proximal portions of the trussing wire leg segments. The bends forming the hooks at the ends of the trussing wire leg segments rest on the base of the elongated rack member between transversely spaced M-shaped support sections. Each of the M-shaped support sections may be provided with a tab extending perpendicularly from an intermediate leg of the M at an end of the support section to prevent the trussing wires from sliding off the rack member.

BRIEF DESCRIPTION OF THE DRAWINGS

These and other other objects, features and many of the attendant advantages of the invention will be better understood upon a reading of the following detailed description when considered in connection with the accompanying drawings wherein like parts in each of the several figures are identified by the same reference numerals, and wherein:

FIG. 1 is a view in perspective of a trussing wire of the type which is stored in accordance with the principals of the present invention;

FIG. 2 is a view in perspective of a storage rack constructed in accordance with the present invention;

FIG. 3 is a view in section of the rack of FIG. 2, taken along lines 3—3 of that figure;

FIG. 4 is a view in plan of the rack of FIG. 2 showing plural trussing wires engaged in the rack in a nesting relation;

FIG. 5 is an end view taken along lines 5—5 of FIG. 4;

DESCRIPTION OF THE PREFERRED EMBODIMENTS

Figure 6:
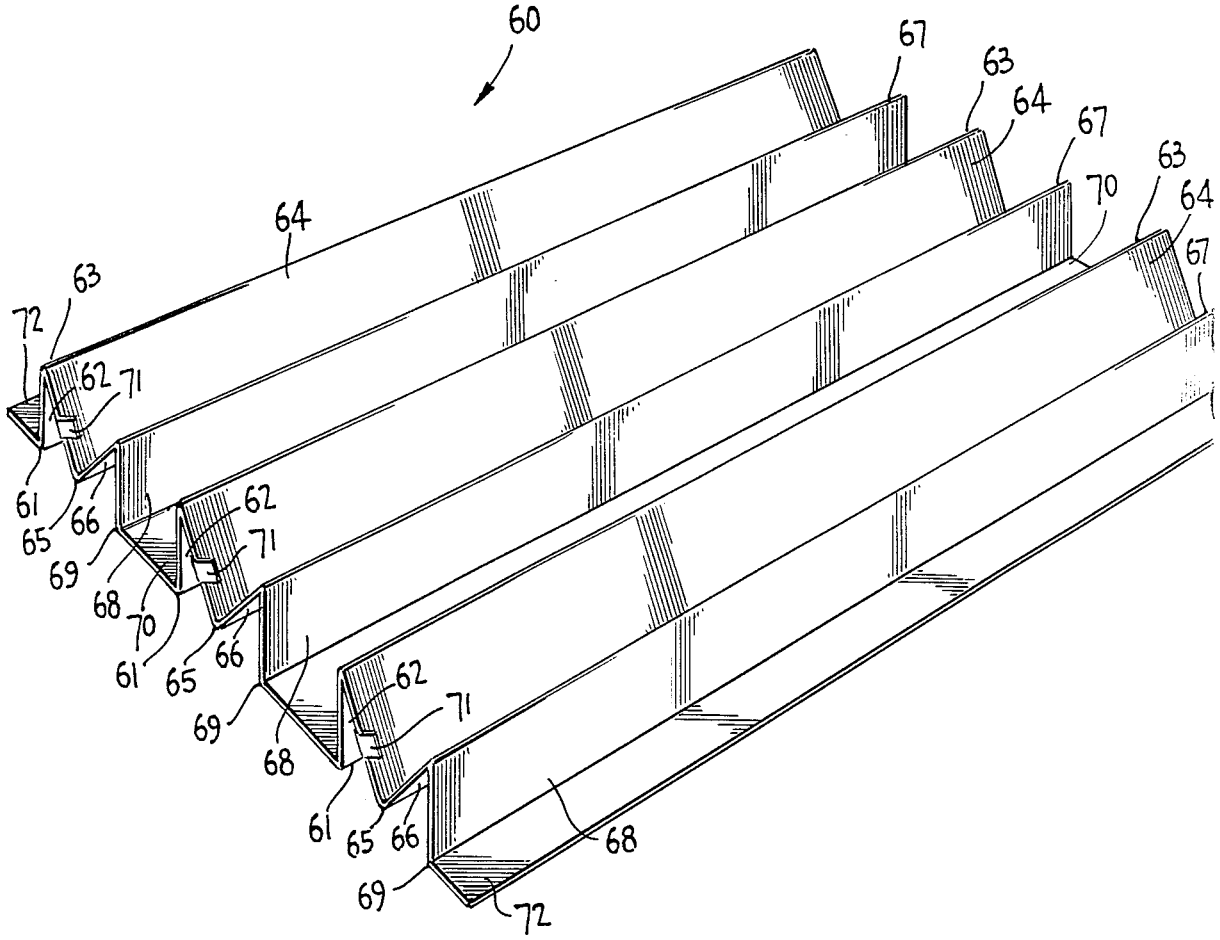
FIG. 6 is a view in perspective of another embodiment of the storage rack of the present invention.
Figure 7:
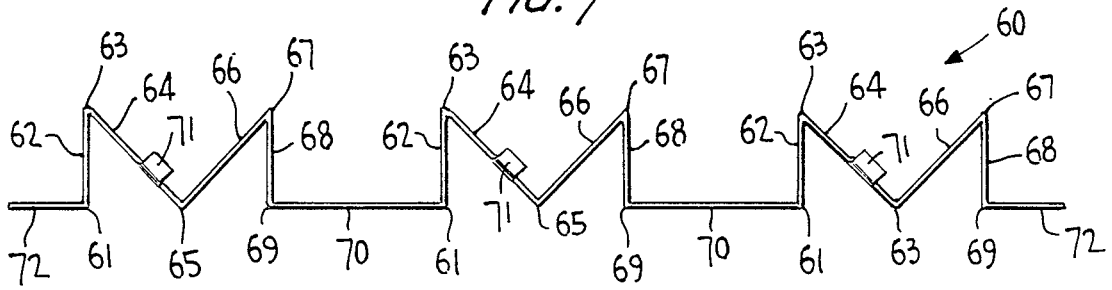
FIG. 7 is an end view in elevation of the rack of FIG. 6.

Referring to the accompanying drawings in greater detail, a poultry trussing wire 10, which is stored according to the present invention, is made of a single length of stiff but resilient metal wire which is bent to comprise plural segments. A V-shaped segment 11 is disposed at the center of the length of wire 10. The point or apex of the V is somewhat rounded to facilitate the trussing procedure. Leg segments 13 and 15 are disposed symetrically with respect to the central V-section 11 and include respective hooked mutually diverging distal ends 17 and 19 and respective bent mutually converging proximal portions 21 and 23. A pair of transition segments 25 and 27 join respective sides of the central V-section 11 to respective proximal portions 21 and 23 of leg segments 13 and 15.

The trussing wire 10 is disposed in three mutually oblique or intersecting planes. A first plane is defined by leg segments 13 and 15 and includes distal ends or hooks 17, 19 and proximal portions 21, 23. A second plane is defined by transition segments 25 and 27 and bends downwardly (as viewed in FIG. 5; into the plane of the drawing, as viewed in FIGS. 1 and 4) through an angle of nominally 65° so as to form a nominal angle of 115° with the first plane defined by leg segments 13 and 15. The third plane is defined by the central V-shaped segment 11 and is bent through another nominally 65° angle, in the same sense as is the second plane, to form a nominal angle of 115° with the second plane defined by transition sections 25, 27. By this configuration, if the bends in hooks 17, 19 are considered to be the rearward most points of the trussing wire 10, the forwardmost points are the ends of transition segments 25, 27 which join center section 11. The center segment 11, in turn, is bent so that its plane forms a nominal angle of 50° with the first plane defined by leg segment 13, 15, and such that the point of the V is directed partially rearward as well as downward.

A cartridge or rack for storing multiple nested trussing wires 10 includes an elongated member 30 made of cardboard, plastic or metal. Member 30 has three longitudinally-extending bends 31, 33 and 35 which subdivide the member 30 into four sections 32, 34, 36 and 38. The first bend 31 is located at substantially the transverse center of member 30 and is nominally 70° to form dihedral angle 110° between sections 32 and 34. The second bend 33 and third bend 35 are equally spaced on opposite transverse sides of the bend 31 and are nominally 135° to form nominal dihedral angles of 45° between sections 32 and 36 and between sections 34 and 38. As a consequence, the longitudinally-extending edges 39, 40 of member 30 are spaced from and face generally toward one another. It should be noted, however, that outer sections 36, 38 are not co-planar but instead, if projected toward one another, would intersect at an angle of nominally 160°.

The transverse space between edges 39 and 40 of member 30 is equal to or, preferably, slightly smaller than the outer spacing between transition segments 25, 27 at their intersection with central V-shaped segment 11 of trussing wire 10. In addition, the interior space of the cartridge, bounded by the interior surfaces of sections 32, 34, 36 and 38, is sufficient to receive all of the central V-shaped segment 11 and transition segments 25, 27 when these are inserted into the rack between opposed edges 39, 40. With trussing wire 10 thus positioned in the rack, as illustrated in FIGS. 4 and 5, the proximal portions 21, 23 of leg segments 13, 15 overlie the outer surfaces of sections 36, 38, respectively. The bends 41, 43 which demark proximal segments 21, 23 overlie and abut the bends 33, 35, respectively, in member 30 so that the main portions of leg segments 13 and 15 form respective acute angles with rack sections 32 and 34. The bends 45, 47 which demark hook or distal portions 17, 19, respectively, of the leg segments project sufficiently far to serve as support points which contact a support surface of a work table when the outer edge of bend 31 of the rack is placed on the work table. The bend points 45, 47 thus prevent the loaded rack or cartridge from tipping over and thereby permit easy removal of the trussing wires 10 from either open end of the rack.

Multiple trussing wires are stored in abutting nesting relationship in the rack 30 as shown in FIG. 4. The wires can be automatically fed into the rack, at the end of a trussing wire fabrication process, through one of the open ends of the rack. In order to prevent the trussing wires from sliding out of the rack or cartridge during shipment or storage, a string-like tape 50 may be employed. Specifically, a pair of short slits 51, 53 is defined inwardly along bend or fold 31 from opposite ends of the cartridge. Each slit 51, 53 may terminate in a hole, if desired, and opposite ends of the tape 50 are inserted therethrough and knotted adjacent to the outer edge of bend 31. The tape 50 extends across the inner surface of the points of the V-sections 11 of each of the trussing wires to hold the wires in place. When it is desired to remove the trussing wires 10 for use, the tape 50 is cut and the wires can be individually slid out of an open end of the cartridge. Of course, it will be appreciated that an endless tape or elastic band may be employed in place of a tape having knotted ends.

The particular numerical angles set forth above should not be construed as limiting the scope of the present invention; rather, the important features of the invention reside in the relative dimensional and angular relationships between the trussing wires 10 and rack 30, which relationships permit the wires to be stored in nesting relationship and to be removed individually. In this regard, the transverse width of rack sections 36, 38 should correspond to or be slightly shorter than the length of proximal portions 21, 23 of leg segments 13, 15. Likewise, the spacing between edges 39, 40 should preferably be small enough to hold central V-shaped segments 11 of the trussing wires 10 in the rack interior and prevent inadvertant removal of the wires through that space. The angle formed between the various bends in rack member 30 may be sufficient to permit wire segments 11, 25 and 27 to be received in the rack or cartridge interior space and to allow proximal leg portions 21, 23 to overlie the outer surfaces of rack sections 36, 38 while hook bends 45, 47 serve as balancing supports with bend 31 on a work table surface.

In the preferred embodiment, the rack is 16 inches long, each of the sections 36, 38 has a width (e.g., from edge 40 to bend 35 of section 38) of $\frac{7}{8}$ inch, and each of sections 32, 34 has a width of $1\frac{5}{8}$ inch. The spacing between edges 39 and 40 is 1.8 inches, and the spacing between bends 33 and 35 is 2.66 inches. Hook sections 17, 19 of trussing wire 10 are approximately $\frac{3}{4}$ inch long, proximal leg sections 21, 23 are approximately 1 inch long, leg sections 13, 15 between bends 41/45 and 43/47 are approximately $2\frac{5}{8}$ inches long, transition sections 25, 27 are approximately $\frac{1}{2}$ inch long, and V-section 11 extends approximately $\frac{3}{4}$ inch from transition sections 25, 27.

The rack or cartridge 30 may be viewed as including two base walls 32, 34 with bend 31 therebetween joining them in common edges, and two front walls 36, 38 in the form of bent sections of the base walls. The front walls each form, with a respective base wall, an angle which is greater than the angle defined between that base wall and a plane in which both edges 39 and 40 reside.

Another embodiment of the present invention is illustrated in the FIGS. 6–9 to which specific reference is now made. A cartridge for storing multiple nested trussing wires 10 includes an elongated member 60 made of cardboard, plastic or metal. Member 60 has three transversely-spaced wire mounting racks, each having five longitudinally-extending bends 61, 63, 65, 67, and 69 which subdivide each mounting rack into four sections 62, 64, 66, 68. Bend 65 is located at substantially the transverse center of each mounting rack and is nominally 90° to form a dihedral angle of 90° between sections 64 and 66. Bend 63 and bend 67 are equally spaced on opposite transverse sides of the bend 64 and and are nominally 135° to form nominal diheral angle of 90° between sections 64 and 66. Bend 63 and bend 67 are equally spaced on opposite transverse side of the bend 65 and are nominally 135° to form nominal dihedral angles of 45° between sections 62 and 64 and between sections 66 and 68. However, instead of being bent toward one another as is the case for the embodiment of FIGS. 1–5, the outer sections 62 and 68 are bent away from one another and away from respective adjacent inner sections 64 and 66. The result is an M-shaped transverse cross-sectional configuration. Bend 61 and 69 are 90° bends which join outer sections 62 and 68, respectively, to respective spacer sections 70 disposed between adjacent racks or to outer end sections 72. These spacer sections 70 and end sections 72 are all preferably co-planar, as illustrated.

Figure 8:
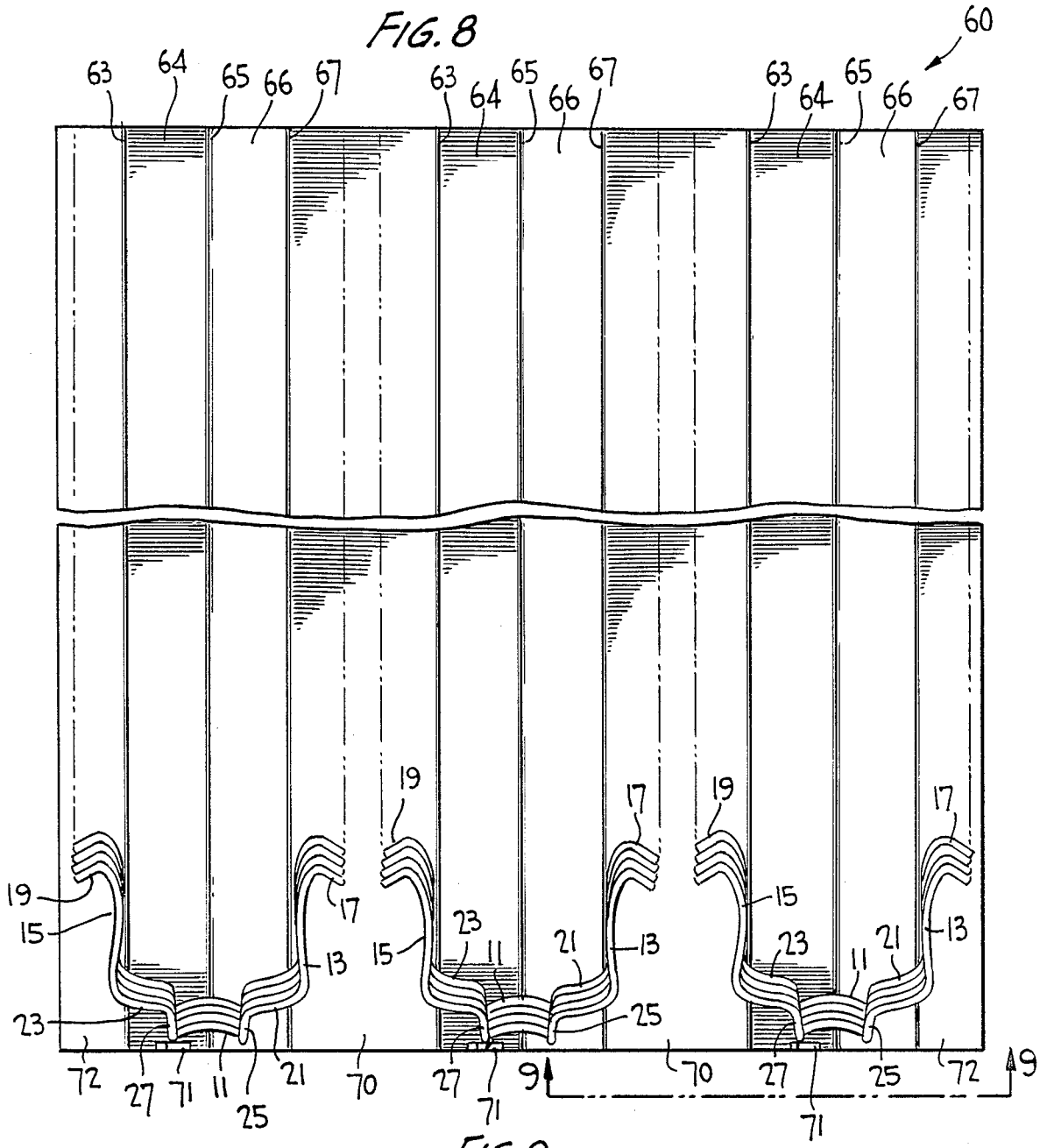
FIG. 8 is a view in plan of the rack of FIG. 6 showing plural trussing wires engaged in the rack in a nesting relation.
Figure 9:
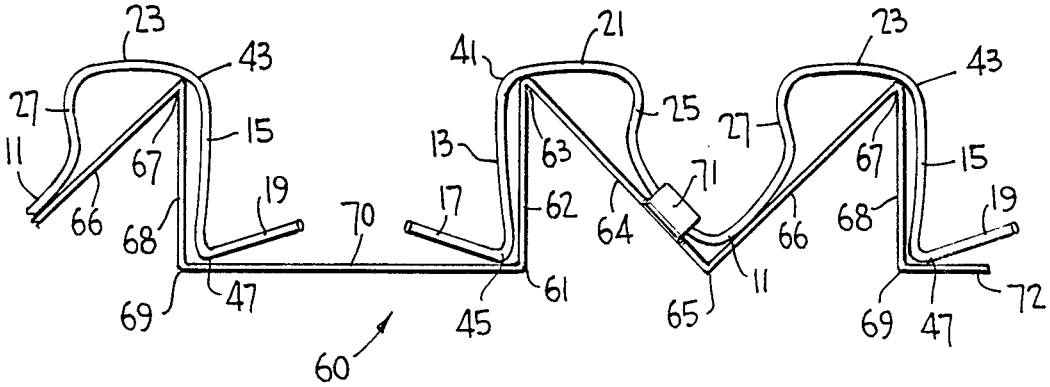
FIG. 9 is an end view in elevation taken along lines 9—9 of FIG. 8.

The interior space of each rack, located between interior sections 64 and 66, is sufficent to receive substantially all of the central V-shaped segment 11 and transition segments 25, 27 of the trussing wires when these wires are inserted into the rack between opposed bends 63, 67. With the trussing wires 10 thus positioned in the rack, as illustrated in FIGS. 8 and 9, the proximal portions 21, 23 of leg segments 13, 15 of the trussing wires extend over the bends 63, 67 and transversely beyond outer sections 62, 68, respectively. The bends 41, 43 which demark proximal segments 21, 23 overlie and abut the bends 63, 67, respectively, and the main portions of leg segments 13 and 15 extend downwardly and longitudinally along the outside of sections 62 and 68 of the rack.

The bends 45, 47 which demark hook or distal portions 17, 19, respectively, of the leg segments of the trussing wires project sufficiently far to serve as support points which comtact spacer sections 70 and end sections 72.

Multiple trussing wires 10 are stored in abutting nesting relationship in each transversely-spaced rack, as shown in FIG. 8. The wires can be automatically fed into each of these three racks, at the end of a trussing wire fabrication process, through the open or unimpeded ends of the racks. A tab 71 is formed integrally with member 60 and extends a short distance perpendicularly from the opposite end of each rack section 64. Tab 71 serves to keep the trussing wires from falling off the racks during shipping and may be removed, if desired, when the wires are to be dispensed.

The particular numerical angles set forth above for the embodiment of FIGS. 6–9 should not be construed as limiting the scope of the present invention; rather, the important features of the invention reside in the relative dimensions and angular relationships between the trussing wires 10 and the racks on member 60, which relationships permit the wires to be stored in nesting relationship and to be removed individually. In this regard, the transverse spacing between bends 63 and 67 should correspond to or be slightly shorter than the transverse distance between bends 41 and 43 of the trussing wires 10. The angle formed between the various bends in the rack members must be sufficient to permit wire segments 11, 25 and 27 to be received in the rack recesses or interior spaces, and to allow proximal leg portions 21, 23 to extend transversely beyond outer rack sections 62, 68 while bends 41, 43 are supported on bends 63, 67 respectively.

In the preferred form of the embodiment of FIGS. 6–9 the member 60 is $15\frac{3}{4}''$ long, each of the racks is $2\frac{1}{2}''$ wide, each spacer 70 between the racks is $2\frac{1}{4}''$ wide, each end section 72 is 1" wide, and each of sections 62, 68 has a width of $1\frac{1}{4}''$.

From the foregoing description, it will be appreciated that the invention makes available a novel rack or cartridge for conveniently storing, shipping and individually removing multiple nested trussing wires.

Having described an embodiment of a new and improved rack or cartridge for storing multiple trussing wires in accordance with the present invention, it is believed that other modifications, variations and changes will be suggested to those skilled in the art in light of the teachings set forth herein. It is therefore to be understood that all such variations, modifications and changes are believed to fall within the scope of the invention as defined by the appended claims.

What I claim is:

1. A cartridge for storing, in nested relationship, a plurality of poultry trussing wires of the type which comprise a length of resilient wire bent in plural longitudinal locations to define a generally V-shaped central segment of predetermined width with a pair of symmetrically disposed co-planar leg segments on opposite sides thereof, said central segment residing in a first plane which intersects at a first predetermined angle, a second plane defined by said leg segments, said cartridge comprising: an elongated member bent along first, second, and third parallel longitudinally-extending linear bends to define a first support rack having first, second, third and fourth rack sections, said first bend having a second predetermined angle and being disposed substantially centered with respect to said second and third bends between said first and second sections, said second bends being disposed between said first and third sections and having a third predetermined angle, said third bend being disposed between said second and fourth sections and having said third predetermined angle, wherein said first and second sections define a recess between said second and third bends, said recess being sufficiently large to receive the V-shaped central segment of multiple nested trussing wires positioned such that opposite leg segments of the trussing wires rest on said second and third bends, respectively.

2. The cartridge according to claim 1 wherein said elongated member includes a plurality of transversely-spaced racks substantially identical to said first rack.

3. The cartridge according to claim 1 wherein said first, second, third and fourth rack sections define a generally M-configured transverse cross-section in which the first and second sections are inner legs and the third and fourth sections are outer legs of the M-configuration.

4. The cartridge according to claim 3 wherein said elongated member includes a plurality of transversely-spaced racks substantially identical to said first rack, wherein each rack includes fourth and fifth longitudinally-extending bends in said elongated member, said fourth and fifth bends being disposed parallel to said first, second, and third bends, and wherein said cartridge further comprises a spacer section disposed between each pair of transversely adjacent racks, each spacer section being terminated along one side by the fourth bend of one of said pair of transversely adjacent racks and along another side by the fifth bend of the other of said pair of transversely adjacent racks.

5. The cartridge according to claim 4 wherein said second predetermined angle of said first bend is sufficantly large relative to the predetermined width of said V-shaped segment of the trussing wire to permit the entire V-shaped segment to be received in said recess by said first and second rack sections.

6. The cartridge according to claim 5 wherein said first, fourth, and fifth bends are approximately 90° each, and wherein said second and third bends are such as to define angles of approximately 45° between said first and fourth rack sections.

7. The cartridge according to claim 3 wherein said second predetermined angle is approximately 90°, and wherein said third predetermined angle is approximately 45°.

8. The cartridge according to claim 1 further comprising tab means formed intergrally with said elongated member and extending out of plane from one of said rack sections for limiting siding motion of said trussing wires along said rack.

9. The cartridge according to claim 1 wherein said elongated member has first and second longitudinally-extending edges transversely terminating said third and fourth sections, respectively, said edges being spaced from one another by a transverse distance approximately equal to said predetermined width of said V-shaped central segment of said trussing wire, and wherein said first, second, third and fourth sections define and interior region open only at the space between said edges and that the ends of said elongated member.

10. The cartridge according to claim 9 wherein said central V-shaped segment of said trussing wires have a maximum width which is slightly greater between the transverse distance between said first and second longitudinally-extending edges.

11. The cartridge according to claim 10 wherein said second predetermined angle is approximately 110°, and wherein said third predetermined angle is approximately 45°.

12. The cartridge according to claim 1 wherein said third and fourth sections of said elongated member reside in mutually intersecting planes.

13. The cartridge according to claim 1 further comprising a pair of slits extending longitudinally inward from opposite ends of said member along said first bend.

14. The cartridge according to claim 13 further comprising means secured at said slits for securing said trussing wires to said cartridge, said means comprising a flexible cord-like member extending through said slits and binding the central V-shaped segments of said trussing wires against said first bend in said interior region.

15. The cartridge according to claim 1 wherein said first, second, third and fourth sections are a part of an intergal part of cardboard.

16. The cartridge according to claim 1 wherein said first, second, third and fourth sections are part of an intergral sheet of metal.

17. The cartridge according to claim 1 wherein said first, second, third and fourth sections are part of an integral sheet of plastic material.

18. A rack for shipping, storing and dispensing multiple poultry trussing wires, comprising: an elongated member having first and second base walls each have first and second longitudinally-extending edges, said base walls intersecting one another along their first edges and forming and angle A therebetween of approximately 110°, and a pair of front walls each having proximal and distal longitudinally-extending edges, the proximal edges of said pair of front walls being joined to and co-extensive with the second edges of said first and second base walls, respectively, at an angle B such that the distal edges are spaced from and generally face toward one another wherein angle B is greater and angle C formed between each base wall and an plane defined by the second edges of said base walls.

19. The rack according to claim 18 wherein said angle B is approximately 45°.

20. The rack according to claim 18 wherein the spacing between the distal edges of said front walls is smaller than the width of the base walls between said first and second edges.

21. A rack for shipping, storing and dispensing multiple poultry trussing wires, comprising: an elongated member having first and second base walls each having first and second longitudinally-extending edges, said base walls intersecting one another along first edges and forming an angle A there between and first and second outer walls each having proximal and distal longitudinally-extending edges, the proximal edges of said first and second outer walls being joined to and co-extensive with the second edges of said first and second base walls, respectively, at an angle B such that the first and second base walls and the first and second outer walls have a transverse cross-section with a generally M-shaped configuration, wherein angle B is less than angle A.

22. The rack according to claim 21 where angle A is approximately 90° and angle B is approximately 45°.

23. The rack according to claim 21 wherein said elongated member further comprises: a first spacer section joined to the distal edge of said second outer wall and extending generally perpendicular to said second outer wall, third and fourth base walls, each having first and second longitudinally-extending edges, said base walls intersecting one another along their first edges and forming an angle A therebetween, and third and fourth outer walls each having proximal and distal longitudinally-extending edges of said third and fourth walls being joined to and co-extensive with the second edges of said third and fourth base walls, respectively, at angle B such that the third and fourth base walls and the third and fourth outer walls have a transverse cross-section with a generally M-shaped configuration, wherein said distal edge of said third outer wall is parallel and spaced from the distal end of said second outer wall and is joined to said spacer section.

24. The rack according to claim 21 wherein said elongated member further comprises: a second spacer section joined to the distal edge of said fourth outer wall and extending generally perpendicular to said fourth outer wall, fifth and sixth base walls, each having first and second longitudinally-extending edges, said fifth and sixth base walls intersecting one another along their first edges and forming an angle A therebetween, and fifth and sixth outer walls each having proximal and distal longitudinally-extending edges, the proximal edges of said fifth and sixth outer walls being joined to and co-extensive with the second edges of said fifth and sixth base walls, respectively, at an angle D such that the fifth and sixth base walls and the fifth and sixth outer walls have a transverse cross-section with a generally M-shaped configuration, wherein said distal edge of said fifth outer wall is parallel to and spaced from the distal edge of said fourth outer wall and is joined to said second spacer section.

* * * * *